US006681690B2

(12) United States Patent
Schaede

(10) Patent No.: US 6,681,690 B2
(45) Date of Patent: Jan. 27, 2004

(54) SHEET-FED PRINTING PRESS WITH SCREEN-PRINTING CYLINDER

(75) Inventor: Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/181,419

(22) PCT Filed: Dec. 16, 2000

(86) PCT No.: PCT/DE00/04505

§ 371 (c)(1),
(2), (4) Date: Jul. 24, 2002

(87) PCT Pub. No.: WO01/54907

PCT Pub. Date: Aug. 2, 2001

(65) Prior Publication Data

US 2003/0015106 A1 Jan. 23, 2003

(30) Foreign Application Priority Data

Jan. 25, 2000 (DE) ..... 100 02 972
May 25, 2000 (DE) ..... 100 25 995

(51) Int. Cl.[7] ..... G41F 15/44
(52) U.S. Cl. ..... 101/120

(58) Field of Search ..... 101/119, 120; 118/413

(56) References Cited

U.S. PATENT DOCUMENTS

| | | | | |
|---|---|---|---|---|
| 3,155,034 A | | 11/1964 | Reinke | 101/120 |
| 4,103,615 A | | 8/1978 | Cruz et al. | 101/120 |
| 4,753,163 A | * | 6/1988 | Blaak | 101/120 |
| 5,156,682 A | * | 10/1992 | Zimmer | 118/119 |
| 5,671,671 A | | 9/1997 | Wyssmann et al. | 101/120 |

FOREIGN PATENT DOCUMENTS

| | | |
|---|---|---|
| DE | 2 040 567 | 2/1971 |
| DE | 26 38 344 | 7/1977 |
| DE | 42 30 448 A1 | 3/1991 |
| EP | 0 392 625 A1 | 10/1990 |
| EP | 0 723 864 A1 | 7/1996 |
| EP | 0 723 864 B1 | 8/1998 |
| GB | 1 268 616 | 3/1972 |
| JP | 63-071350 A | 3/1988 |

* cited by examiner

*Primary Examiner*—Stephen R. Funk
(74) *Attorney, Agent, or Firm*—Jones, Tullar & Cooper, PC

(57) ABSTRACT

A printing unit of a sheet-fed printing press includes two cooperating screen-printing cylinders which are in direct contact. These two screen-printing cylinders define a printing gap through which the sheets to be printed pass during their printing step.

2 Claims, 4 Drawing Sheets

SHEET-FED PRINTING PRESS WITH SCREEN-PRINTING CYLINDER

FIELD OF THE INVENTION

The present invention is directed to a printing unit with a screen-printing cylinder. The screen printing cylinder has a movable doctor blade device. Two directly cooperating screen-printing cylinders, each with at least one working doctor blade, may also be provided.

BACKGROUND OF THE INVENTION

EP 07 23 864 B1 has disclosed a printing unit for a rotary printing press. A first screen-printing cylinder, together with a second cylinder, forms a printing nip, in which a print stock is printed.

This known printing unit is only suitable for one-sided printing.

DE 26 38 344 A1 discloses two cooperating screen-printing cylinders.

JP 63-071350 A discloses two opposing printing cylinders, each with a doctor blade. A separation between a doctor blade and a counter-pressure device is not provided.

SUMMARY OF THE INVENTION

The object of the present invention is to provide a printing unit with a screen-printing cylinder.

The object is attained according to the invention by the provision of at least one screen-printing cylinder with a movable doctor blade. Two directly cooperating screen-printing cylinders can also be used. Each has a working doctor blade and a counter-pressure device. The counter-pressure device of one of the screen-printing cylinders supports the working doctor blade of the other screen-printing cylinder.

The advantages that can be achieved with the present invention are comprised particularly in the fact that the printing press permits first forme printing and second forme printing in the screen-printing process with matching registers to be executed in a single printing procedure.

To this end, the present invention provides that the second cylinder is also a screen-printing cylinder so that each screen-printing cylinder is used to print a respective side of a print stock being fed through the printing nip which is defined by the two screen-printing cylinders.

In order to permit an exact, register-matching printing, even at the edge of a sheet-like print stock, preferably at least one of the two screen-printing cylinders is equipped with a sheet gripping mechanism for the sheet-like print stock.

In order for this sheet gripping mechanism to be able to pass through the printing nip, it is necessary for at least one of the two screen-printing cylinders to have an indentation on its circumference surface. A doctor blade device disposed inside the screen-printing cylinder can preferably be moved radially so that it can move out of the way of the indentation.

It is also preferable for the doctor blade devices of the two screen-printing cylinders to each have a working doctor blade, each of which working doctor blades which touches the interior of the screen of its respective screen-printing cylinder when pressing ink through it, the respective working doctor blades of the two doctor blade devices being exactly aligned with each other, so that the working doctor blade of each doctor blade device compensates for a pressure exerted on its screen by the working doctor blade of the other. This arrangement provides the simple assurance that there is a sufficient pressure in the printing nip to press the ink required for the printing through the screens and to transfer it onto the print stock. On the other hand, an undesirable deformation of each screen by the pressure of the doctor blade device associated with it is prevented because the respective other doctor blade device exerts a corresponding counter-pressure.

Alternatively to this, each doctor blade device can also have a counter-pressure device spaced apart from its associated working doctor blade in the circumference direction of the screen-printing cylinder. Each such counter-pressure device is aligned with the respective working doctor blade of the other doctor blade device and compensates for the pressure which this other doctor blade device exerts.

In addition to their previously well-known and customary task of applying ink to the screen-printing cylinder, the doctor blade devices thus also perform the task of the counter-pressure cylinder that is usually provided.

BRIEF DESCRIPTION OF THE DRAWINGS

Preferred embodiments of the present invention are shown in the drawings and will be described in detail below.

DESCRIPTION OF THE PREFERRED EMBODIMENTS

Figure 1:
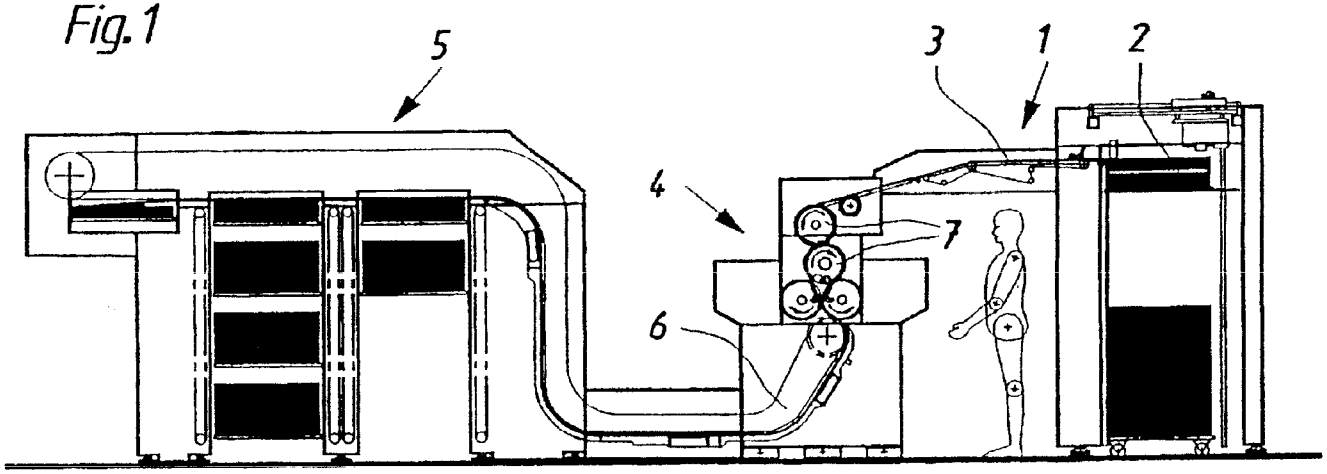
FIG. 1 is a schematic representation of a printing press with a printing unit in accordance with the present invention.

Referring initially to FIG. 1, there is shown a schematic view, e.g. of a sheet-fed rotary printing press in which a printing unit 4, in accordance with the present invention, is used. The printing press has a sheet feeder 1 with a sheet stacker 2, from whose top, which is automatically kept at a constant height, sheets to be printed are fed individually or in a continuous stream by a belt conveyor 3 to the printing unit 4. The printing unit 4 takes the sheets, one at a time, prints them, and outputs them to a second chain conveyor 6, which, in the case of multicolor printing, feeds them to other printing units like the printing unit 4 or, as shown here, feeds them directly to an output stack 5.

The sheets pass through the printing unit 4 from top to bottom. The printing unit can be seen more clearly in FIG. 2 which gives a larger scale depiction of its structure.

Figure 2:
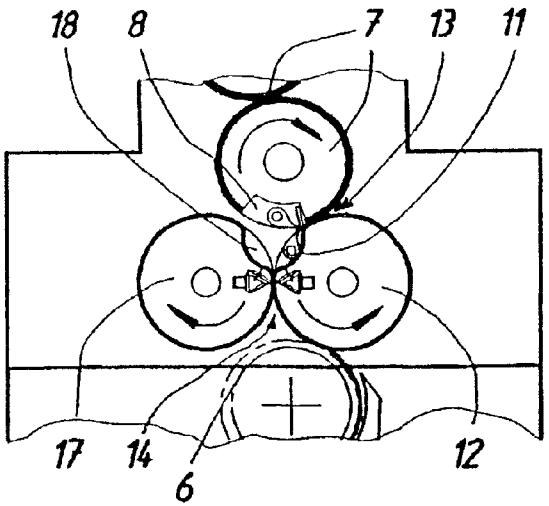
FIG. 2 shows a schematic section through the printing unit of the machine of FIG. 1.
Figure 3A:
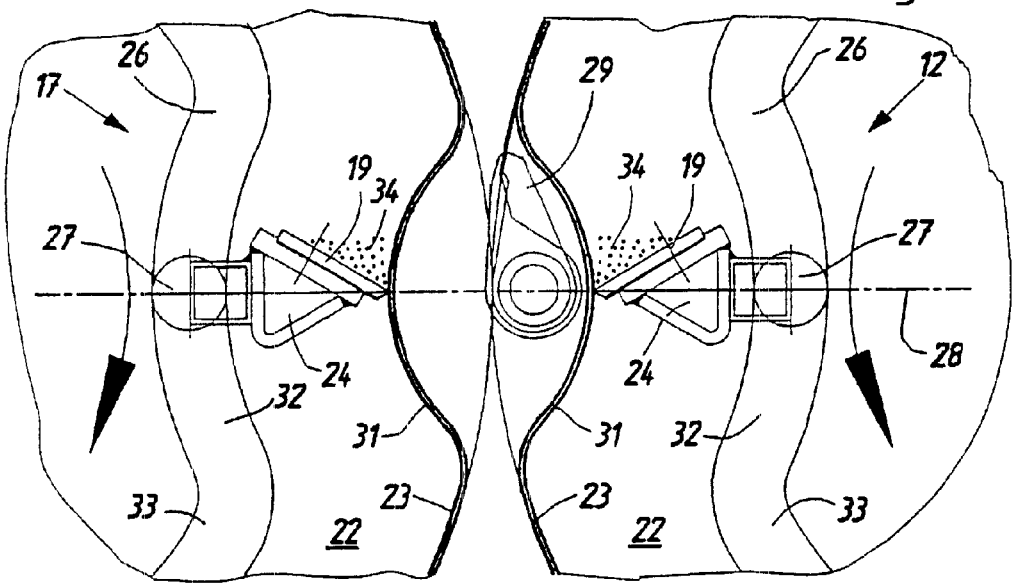
FIGS. 3*a* and 3*b* respectively show the printing nip and partial regions of the screen-printing cylinders that form the printing nip, in accordance with a first preferred embodiment of the printing unit of the present invention, in two phases of its rotary motion.

Two transport cylinders 7, the upper of which is shown only partially in FIG. 2, are each provided with sheet gripping mechanisms, each in a respective section 8 of their circumferences, in order to grip the leading edges of sheets, which are to be printed, from the first belt conveyor 3 in a register-matching manner. The lower of the two transport cylinders 7 rolls in contact with a first screen-printing cylinder 12, which is likewise equipped with a sheet leading edge gripping mechanism 29 in a section 11 of its circumference. In particular, this sheet leading edge gripping mechanism 29 may be a rotatable shaft with sheet gripper fingers, as seen in FIG. 3*a* and which is adapted for taking the sheets from the lower transport cylinder 7. The first screen-printing cylinder 12, together with a second screen-printing cylinder 17, forms a printing nip 14 through which the sheets held by the sheet leading edge gripper 29 of the first screen-printing cylinder 12 are conveyed. The two screen-printing cylinders 12 and 17 can be rotated in unison in such a way that with each pass through the printing nip 14, the sheet gripper 29 of the first screen-printing cylinder 12 coincides with, or is aligned with, a channel-like indented section 18 of the second screen-printing cylinder 17.

The operation of the screen-printing cylinders 12 and 17 and a first preferred embodiment of their construction will be described below, and taken in conjunction with FIGS. 3*a* and 3*b*.

Figure 3B:
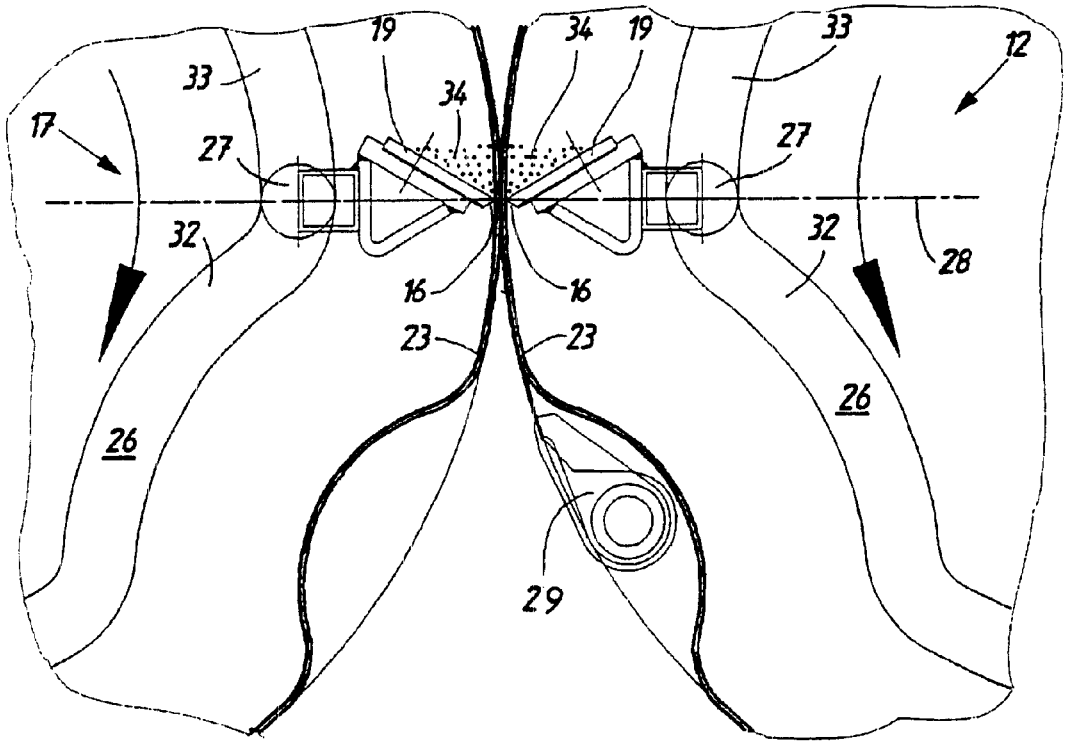

FIGS. 3*a* and 3*b* each show a view of a partial section of the two cooperating and coacting screen-printing cylinders 12 and 17 in the vicinity of the printing nip 14.

At each of its axial ends, each screen-printing cylinder 12 and 17 has a support ring 22 whose outer circumference has a screen 23 stretched onto it. Each screen 23 is preferably made of silk or polyamide gauze or bronze wire mesh. On the interior of each screen-printing cylinder 12 and 17, a doctor blade device 24 is provided, whose position in the radial direction of its associated screen-printing cylinder is controlled by a curved body, in this instance a guide slot 26 situated at the ends of the screen-printing cylinder 12 or 17, and through which slot 26 a cylindrical guide projection 27 of the doctor blade device 24 extends. Outside the screen-printing cylinder 12 or 17, the guide projection 27 is supported at both ends so that it can move in the direction of a line 28 extending between and connecting the rotation axes of the screen-printing cylinder 12 and the screen-printing cylinder 17. FIG. 3*a* shows the doctor blade device 24 in a position in which the sheet gripper 29 of the screen-printing cylinder 12 is passing through the printing nip 14 between the two cylinders. In the vicinity of the sheet gripper 29 and opposite from it, the screen 23 has a screen section 31 that is indented radially inward. The guide slot 26 has an arc-shaped guide slot section 33, which is not shown completely in FIG. 3*a*, and which is concentric to the cylindrical outer surface of the screen 23, and an inwardly indented guide slot section 32, whose curvature corresponds to that of the screen section 31. The curvature of the guide slot section 32 is selected so that when the guide slot section 32 moves past the guide projection 27 during the rotation of the screen-printing cylinder 12, the doctor blade device 24 is retracted radially inward so far that it exerts only a minimal pressure against the screen 23, which minimal pressure produces no appreciable deformation of the screen 23 in the screen section 31, or the doctor blade device 24 is retracted so far that it loses all contact with the screen 23 and consequently exerts no pressure on its screen section 31, which pressure could otherwise deform this screen section 31 and damage it during the course of operation.

FIG. 3*b* shows the position of the doctor blade devices 24 after the guide slot section 32 has passed the guide projection 27. The arc-shaped section 33 of the guide slot 26 keeps the doctor blade devices 24 pressed against the inside of the screen 23 so that an ink 34 disposed against a working doctor blade 19 of the doctor blade device 24 is pressed through the open regions of the screen 23 and is thus applied to a sheet of print stock conveyed through the printing nip 14 defined by the two screen-printing cylinders 12 and 17.

In this phase of the rotation of the two screen-printing cylinders 12 and 17, the respective lips 16 of the two working doctor blades 19 touching the screens 23 are oriented toward each other and rest exactly in a plane defined by the axes of the two screen-printing cylinders 12 and 17, which plane is represented by the line 28 in FIG. 3*b*

The parallelism of the lips 16 is of great importance for satisfactory printing results. If the lips 16 are not parallel to each other, but rather intersect at an angle, there is the possibility that away from the intersecting point of the two respective doctor blade lips 16, the screen 23 will move away from the pressure exerted against its inside by the doctor blade device 24, with the result that little or no ink 34 is pushed through the screen 23, and this ink, for lack of effective pressure, is transferred either incompletely or not at all to a sheet being fed through the printing nip 14.

It is easy to see that the requirement for the lips 16 to be parallel is greater, the narrower the zone is in which the lip 16 and screen 23 contact each other. It is consequently useful to select the elasticity of the material of the working doctor blades 19 and the pressure of the doctor blade device 24 against the screen 23 to be great enough for a sufficient width of the contact zone of the lips 16 to be produced. With an axial length of the screen-printing cylinders 12 and 17 of approximately 800 to 900 mm, it is desirable for the contact zone to extend at least 0.05 to 1 mm, preferably approx. 0.3 to 0.4 mm in the circumference direction of the screen-printing cylinders 12 and 17. With axial lengths that differ from this, a proportionally larger or smaller width of the contact zone can be selected.

Figure 4:
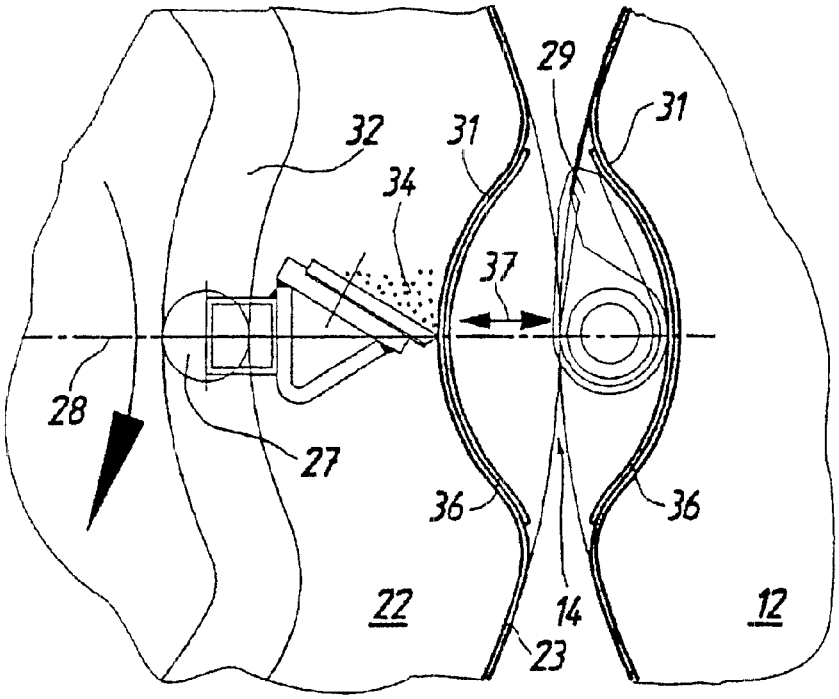
FIGS. 4 and 5 show two configurations of an indented section of the circumference surface of the screen-printing cylinder.

In accordance with a second preferred embodiment of the present invention, as shown in FIG. 4, the doctor blade device 24 of the screen-printing cylinder 17 remains in contact with the screen 23 even during its passage through the indented screen section 31. In this case, in order to prevent the doctor blade device 24 from deforming the screen 23 in the screen section 31, the screen 23 is supported on the outside of the screen 23, in the area of the screen section 31 by a support element 36. The support element 36 here has the shape of a basin or a trough that is uniformly curved in cross section. The support element 36 may be, for example, made of sheet metal or a rigid plastic, and is anchored at its two axial ends to the ends of the screen-printing cylinder 17. Advantageously, the leading and trailing ends of the screen 23 are also disposed in the screen section 31, where they are covered by the support element 36. The support element 36 can be adjusted in the radial direction, which is indicated by the arrow 37 in FIG. 4, in order to set the tension of the screen 23.

The screen-printing cylinder 12, which cooperates with the above-described screen-printing cylinder 17 has a corresponding support element 36 in its indented screen section 31. This may also be seen by referring to FIG. 4.

Since no ink can be transferred from the screen-printing cylinders 12; 17 to the print stock in the indented screen sections 31 supported by the support element 36, it is useful for the support element 36 to be a closed plate which does not permit any ink 34 to pass through and reach the exterior of the screen-printing cylinder 12; 17.

Figure 5:
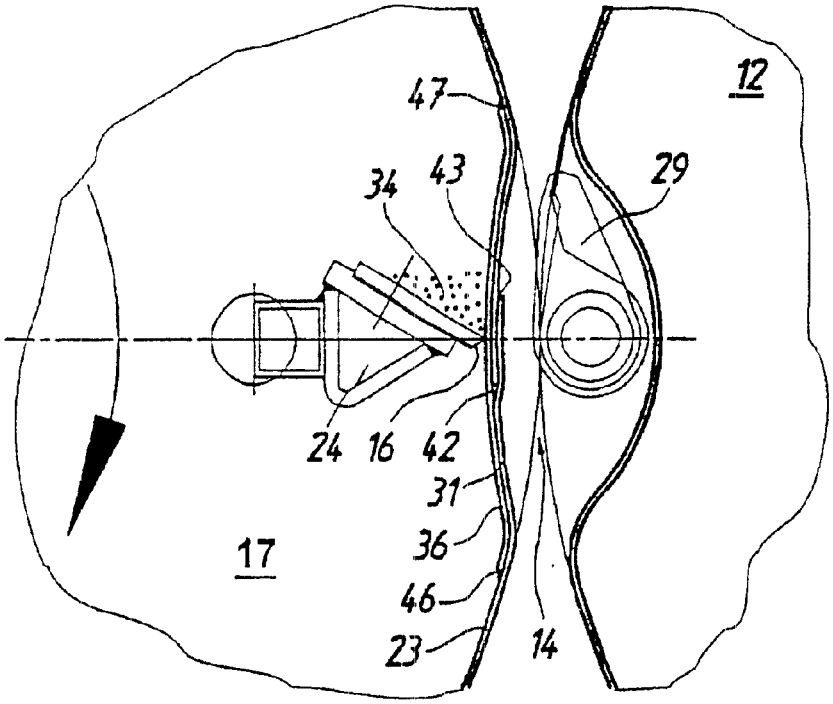

FIG. 5 depicts an alternative construction of the screen-printing cylinder 17 of the present invention.

The support element 36 depicted in FIG. 5 is affixed radially inside the screen 23. The leading end 42 and the trailing end 43 of the screen 23 overlap each other in the indented screen section 31 which is supported by the support element 36. In this manner, the sensitive connection between the two ends 42 and 43 of the screen 23, which two screen ends 42 and 43 can be welded to each other, for example, is protected from contact with the lip 16 of the doctor blade device 24 and thus from premature wear.

Also in this embodiment of a screen-printing cylinder 17, as shown in FIG. 5, an adjusting element can be provided for adjusting the doctor blade device 24 in the radial direction, for example in the guide slot 26 shown in FIGS. 3*a*, 3*b*. However, since in this embodiment, the inner radius of the surface of screen 23 that is wiped by the doctor blade device 24 only fluctuates minimally, it is sufficient to compensate for these minimal fluctuations solely by the provision of a radially flexible support, which is not specifically shown, for the doctor blade device 24.

In order to prevent synchronization errors in the screen-printing cylinder 17 with such a construction, when the working doctor blade 19 passes a leading edge 46 or a trailing edge 47 of the support element 36, the subject invention provides that these edges 46 and 47 do not extend exactly parallel to a generatrix of the outer surface of the screen-printing cylinder 17 or to the lip 16 of the doctor blade device 24, but extend at a slight angle with respect to that generatrix or lip. For example, a sawtoothed, rafter-shaped, or sinusoidal curve of the edges 46 and 47 is possible. Preferably the edges 46 and 47 each represent a helix with a pitch that is a multiple of the axial length of the screen-printing cylinder 17. When the doctor blade device 24 is running onto them or off of them, such a curvature of the edges 46 and 47 prevents braking or acceleration forces acting on the screen-printing cylinder 17 from being exerted only at a certain point in time and at a particular angular position of the screen-printing cylinder 17. Instead, these forces are distributed over a circumferential section of the screen-printing cylinder 17 which, depending on the dimensions of the screen-printing cylinder 17, can be from several millimeters up to a few centimeters wide. This smoothes the torque required to drive the screen-printing cylinder 17 and prevents synchronization errors.

Figure 6:
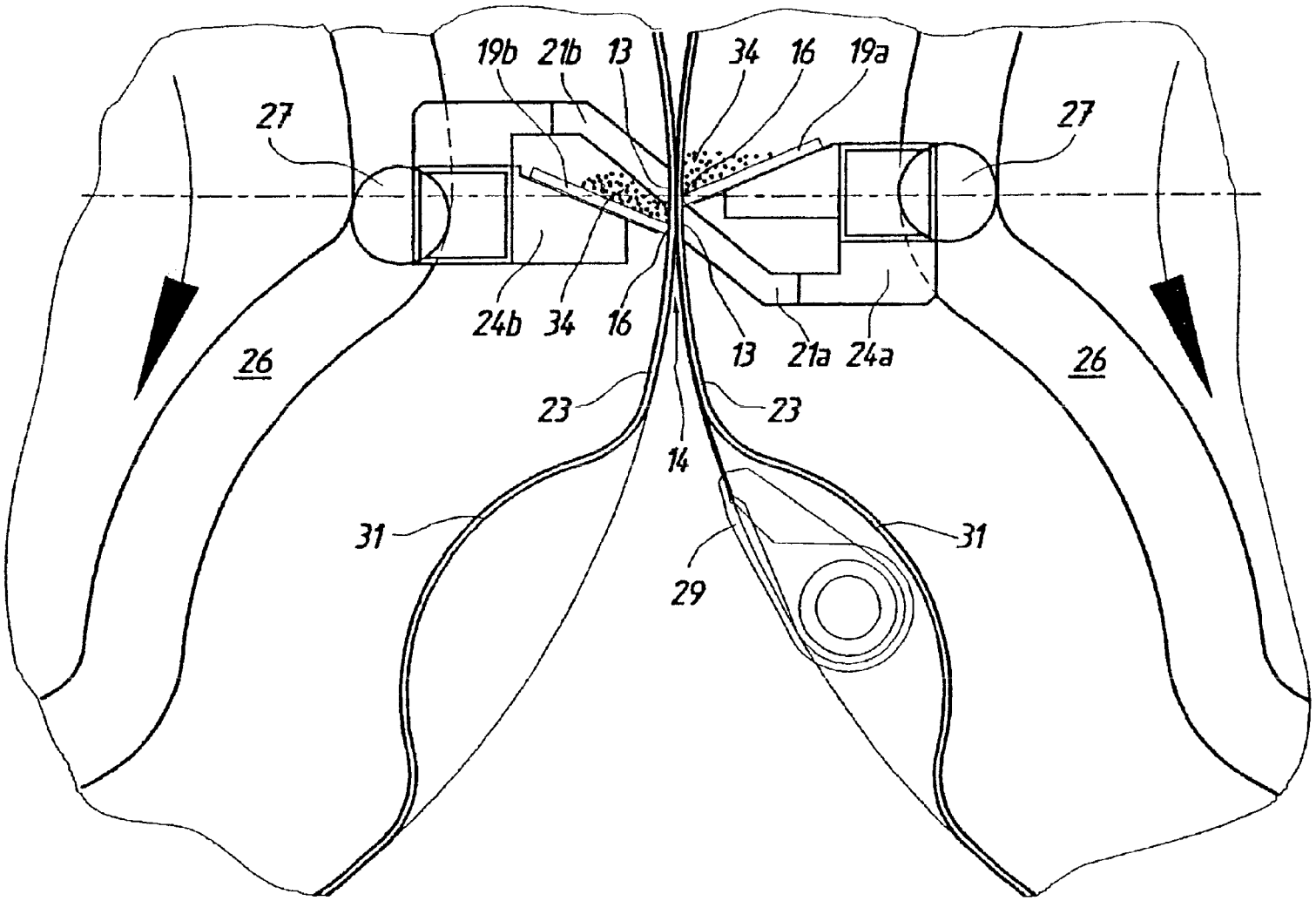
FIG. 6 shows the printing nip and partial regions of the screen-printing cylinders that form the printing nip, in accordance witha second preferred embodiment of the printing unit of the present invention.

FIG. 6 is an axial section view in the vicinity of a printing nip 14 of another preferred embodiment of the printing unit 4 according to the present invention, in the same phase of its rotational movement as the one shown in FIG. 3*b*. Elements which are depicted in FIG. 6, and correspond to those that have already been described in relation to FIGS. 3*a* and 3*b*, are provided with the same reference numerals in FIG. 6 and will not be described again in the following discussion.

The difference between this depicted embodiment of the sheet-fed printing press with screen-printing cylinders, in accordance with the present invention, and the ones described with reference to FIGS. 3*a* and 3*b*, 4, and 5 lies in the configuration of the doctor blade devices 24. The printing unit 4 depicted in FIG. 6 has two differently embodied doctor blade devices 24*a* and 24*b*. Each of them has a working doctor blade 19*a*, 19*b*, respectively which is made of an elastically deformable material with a lip 16, which, during the course of the rotary motion of the screen-printing cylinder 17, sweeps along the inside of the screen 23 in order to press ink 34 through screen 23. Separate from the lips 16 and parallel to them, each doctor blade device 24*a* and 24*b* has a counter-pressure device 21*a* or 21*b*, respectively in the form of a bridge that extends, in the axial direction of the screen-printing cylinder 17, over the same length as the working doctor blade 19*a* or 19*b* and which has an end surface 13 which sweeps along the inside of the screen 23. Each counter-pressure device 21*a* or 21*b* is respectively aligned so that an end surface 13 of each such counter-pressure device 21*a* or 21*b* is disposed opposite from the lip 16 of the working doctor blade 19*b* or 19*a* of the respective opposing doctor blade device 24*b*, 24*a*. The purpose of these counter-pressure devices 21*a* and 21*b* is to provide a buttress or a counter-acting support for the pressure exerted by the opposing working doctor blade 19*b* or 19*a*, respectively, which buttress or support assures that a sufficient quantity of ink passes through the screen 23 and is printed with high quality on print stock being fed through the printing nip 14. The end surface 13 of each of the counter-pressure devices 21*a* and 21*b* can have a width of several millimeters in the circumference direction. This assures that, even when the two doctor blade devices 24*a* and 24*b* are slightly out of parallel, the pressure of each lip 16 is compensated for over its entire length by the cooperating counter-pressure device. As a result, a uniform printing quality is achieved over the entire width of the print stock.

In the doctor blade device 24*a*, the working doctor blade 19*a* is disposed before the counter-pressure device 21*a* in the rotation direction of the screens 23. In the doctor blade device 24*b*, this is reversed. The doctor blade device 24*b* can therefore be embodied as a chamber doctor blade in which the counter-pressure device 21*b* constitutes a closing doctor blade. The chamber defined by the working doctor blade 19*b* and counter-pressure device 21*b* can be subjected to pressure in order to control the flow rate of the ink provided in the chamber defined by the working doctor blade 19*b* and the counter-pressure device 21*b*.

Although not specifically shown in FIG. 6, in this embodiment of the screen-printing cylinders 12 and 17, the indented screen sections 31 can be equipped with support elements 36, as shown in FIGS. 4 and 5.

While preferred embodiments of a sheet-fed printing press with screen-printing cylinders in accordance with the present invention have been set forth fully and completely hereinabove, it will be apparent to one of skill in the art that various changes in, for example the drives for the cylinders, the types of sheets being printed, and the like can be made without departing from the true spirit and scope of the present invention which is to be limited only by the following claims.

What is claimed is:

1. A printing unit comprising:

a first screen-printing cylinder having a first doctor blade device including a first working doctor blade and a first counter-pressure device, said first screen-printing cylinder being rotatable in a first direction;

a second screen-printing cylinder having a second doctor blade device including a second working doctor blade and a second counter-pressure device, said second screen-printing cylinder being rotatable in a second direction, said first screen-printing cylinder and said second screen-printing cylinder being in direct contact, said counter-pressure device in each said first and second doctor blade devices being positioned in its respective one of said first and second screen-printing cylinders to support said working doctor blade in each said second and first doctor blade devices in its respective one of said second and first screen-printing cylinders; and ink disposed in said first screen-printing cylinder between, in said first direction of rotation, said first working doctor blade and said first counter-pressure device, and ink disposed in said second screen-printing cylinder before, in said second direction of rotation, said second working doctor blade and said second counter-pressure device.

2. The printing unit of claim 1 wherein said first doctor blade device is a chamber doctor blade and said counter-pressure device is a closing doctor blade of said chamber doctor blade.

* * * * *